United States Patent [19]

Hill

[11] 4,280,690

[45] Jul. 28, 1981

[54] COLLATOR

[76] Inventor: James Hill, 116 Silverdale Rd., Sheffield S11 9JL, England

[21] Appl. No.: 57,328

[22] Filed: Jul. 13, 1979

[30] Foreign Application Priority Data

Jul. 21, 1978 [GB] United Kingdom ..... 30762/78

[51] Int. Cl.[3] ..... B65H 39/06

[52] U.S. Cl. ..... 270/58; 198/420; 198/422

[58] Field of Search ..... 270/58; 271/251, 9; 198/420, 422; 414/86, 90, 91

[56] References Cited

U.S. PATENT DOCUMENTS

| | | | |
|---|---|---|---|
| 2,661,215 | 12/1953 | Stevens | 270/58 X |
| 2,879,991 | 3/1959 | Pitner | 270/58 |
| 2,930,476 | 3/1960 | Andrews | 270/58 X |
| 2,997,187 | 8/1961 | Burt | 198/422 X |
| 3,175,821 | 3/1965 | Gibson | 270/58 |
| 3,250,372 | 5/1966 | Wagner et al. | 198/420 X |
| 3,966,186 | 6/1976 | Helm | 270/58 |
| 4,111,412 | 9/1978 | Cathers | 271/251 |

*Primary Examiner*—Edward M. Coven

*Attorney, Agent, or Firm*—Bauer & Amer

[57] ABSTRACT

Apparatus for producing a superposed collated assemblage of sheet material on a conveyor, wherein the individual sheets are transported from sources of supply along angled paths intersecting the conveyor, and result in the deposit of the sheets on top of each other and on the conveyor in the desired collated condition as noted.

6 Claims, 2 Drawing Figures

COLLATOR

Figure 1:
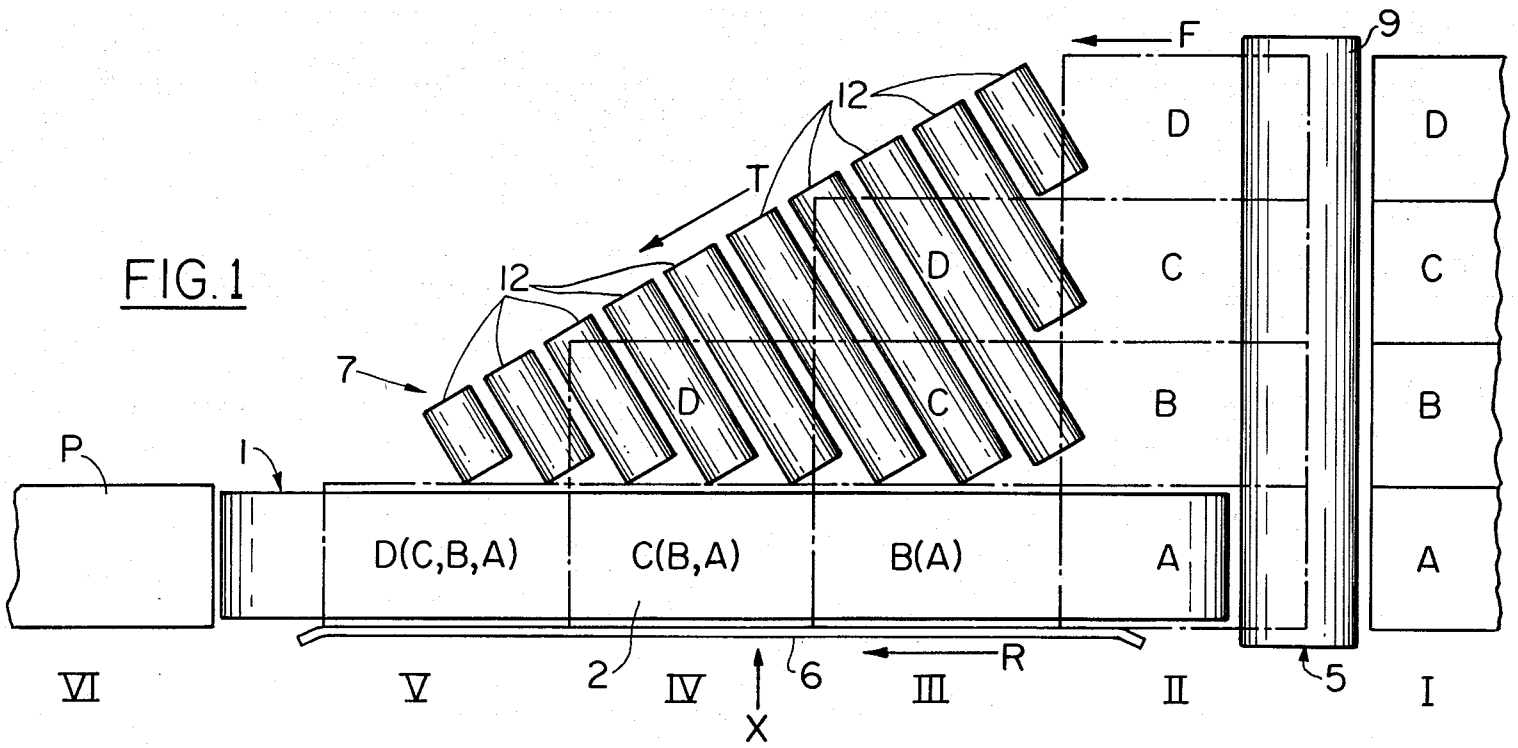

This invention relates to a collator for pieces of paper, card or other sheet material, which pieces may have to be cut from a single sheet, and has for its object providing a collator in which the general direction of movement of the pieces is the same after collating as before collating.

According to a method of collating pieces of paper, card or other sheet material the collating comprises feeding the pieces abreast in a row, allowing the pieces at one end of the row to drop to a level below the remaining pieces, and superimposing a transverse feeding on the remaining pieces towards the dropped piece, whereby the remaining pieces are dropped in order on to the initially dropped piece whilst continuing to feed all the pieces in the same general direction.

The speed of the superimposed transverse feed in relation to the speed of feed of the initially dropped piece may be such that the remaining pieces drop into register with the preceding dropped piece, or the relative speeds may be such that each of the remaining pieces drops into an overlapping position with respect to the preceding dropped piece.

According to the present invention, a collator for carrying out the above method comprises a conveyor having a forwarding run between leading and return drums, forward feed means for pieces of paper, card or other sheet material at a level above that of the forwarding run and extending from adjacent the leading drum laterally to one side of the conveyor, guide means upstanding along the forwarding run and at or towards the other side of the conveyor, and transverse feed means for the pieces in a plane parallel to the plane of the forward feed means and the forwarding run of the conveyor but at a level above that of the forwarding run and not above the plane of the pieces at the forward feed means, the direction of feed of the transverse feed means being inclined to the direction of feed of the forward feed means and converging on the forwarding run of the conveyor in the direction of movement of the latter.

The conveyor preferably consists of a plurality of parallel belts, and the guide means consists of a rigid strip removably mounted for positioning between any pair of the belts or adjacent belt remote from the transverse feed means.

The forward feed means may be a pair of rollers or pairs of rollers extending transversely to the conveyor, and the pair or pairs of rollers may be parts of a slitting (and, possibly also, perforating and/or printing) machine for the sheet material.

The transverse feed means preferably consists of upper and lower banks of driven rollers in parallel pairs with their axes inclined to the direction of feeding of the forward feed means and the forwarding run of the conveyor, the banks of rollers having an entry end perpendicular to the conveyor and adjacent the forward feed means and having an exit side parallel to the conveyor and adjacent thereto.

Figure 2:
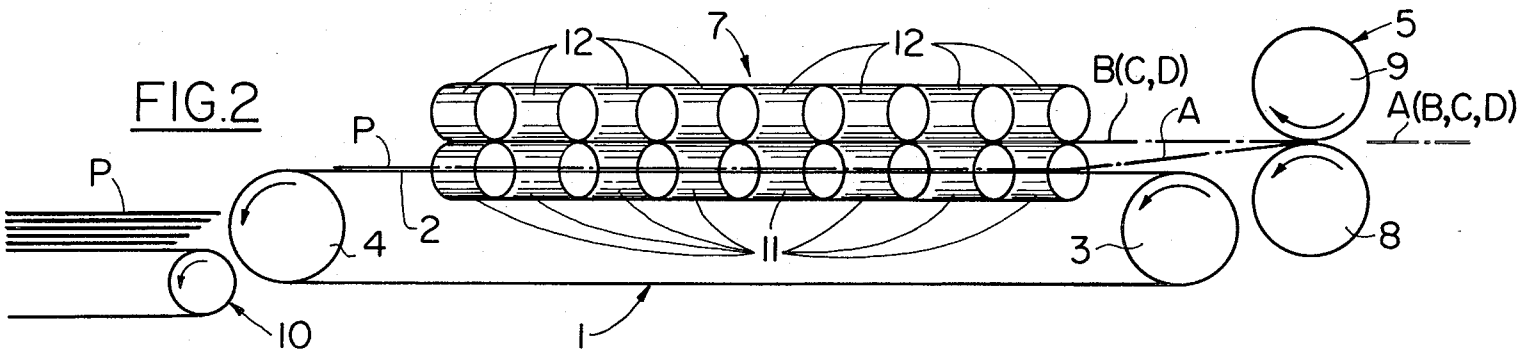

The basic method of the invention will now be described with reference to the accompanying drawings, in which:

FIG. 1 is a diagrammatic plan of a preferred embodiment of the collator in accordance with the invention; and FIG. 2 is a diagrammatic side view of the collator in the direction of arrow X in FIG. 1.

In the drawings, the collator comprises a conveyor 1 having a forwarding run 2 between leading and return drums 3, 4 respectively, forward feed means 5 for pieces A, B, C, D of paper, card or other sheet material at a level above that of the forwarding run 2 and extending from adjacent the leading drum 3 laterally to one side of the conveyor 1, guide means 6 (FIG. 1 only) upstanding along the forwarding run and at the other side of the conveyor, and transverse feed means 7 for the pieces in a plane parallel to the plane of the forward feed means 5 and the forwarding run 2 of the conveyor 1 but at a level above that of the forwarding run and not above the plane of the pieces at the forward feed means, the direction of feed T of the transverse means 7 being inclined to the direction of feed F of the forward feed means 5 and converging on the forwarding run 2 of the conveyor 1 in the direction of movement R of the latter.

The method by which the collator operates comprises feeding the pieces A to D abreast in a row by the forward feed means 5, allowing the piece A at one end of the row to drop on to the forwarding run 2 of the conveyor 1 at a level below the remaining pieces B to D, and superimposing a transverse feeding on the remaining pieces towards the dropped piece by the transverse feed means 7, whereby the remaining pieces are dropped in order on to the initially dropped piece whilst continuing to feed all the pieces in the same general direction.

Although the movements are all continuous the positions of the pieces A to D can be considered in stages, as indicated in FIG. 1. Stage I is when the pieces are approaching the collimator, but if the forward feed means 5 has, instead of plain rollers 8, 9, slitting rollers (e.g. of a slitting and, possibly also, perforating and/or printing machine) then at stage I A to D would be represented as an unslit sheet. At stage II end piece A is dropping on to the forward run 2 of the conveyor 1 and the remaining pieces B, C, D are just entering the transverse feeding means 7. At stage III the pieces B, C, D have moved transversely by one piece width and B has dropped on to A. At stage IV the pieces C, D have moved transversely by a further one piece width and C has dropped on to B, which is on top of A. At stage V the piece D has moved transversely by yet another one piece width and has dropped on to C, which is on top of B, in turn on top of A. At stage VI the finished collated pack P of pieces A to D has been discharged from the collator and can be transported therefrom (as by a conveyor 1) to, for example, a binding machine, along with similar packs with which it is to be associated (FIG. 2 only).

Although not shown in the drawings, the conveyor 1 preferably consists of a plurality of parallel belts and the guide means 6 consists of a rigid strip removably mounted for positioning between any pair of the belts as an alternative to the position shown in FIG. 1 adjacent the belt remote from the transverse feed means.

The transverse feed means consists of upper and lower banks of driven rollers 11, 12 in parallel pairs with their axes inclined to the direction of feeding F of the forward feed means 5 and the forwarding run 2 of the conveyor 1, the banks of rollers having an entry end perpendicular to the conveyor and adjacent the forward feed means and having an exit side parallel to the conveyor and adjacent thereto.

It will be appreciated that with the method of collating and the collator in accordance with the invention collating takes place without stopping or slowing down the rate of feeding of the pieces of material, which is a tremendous advantage over the known methods and collators in which the feed stops and then collating takes place at right angles thereto and, in addition, it is of almost equal importance that the general direction of feeding remains unaltered as compared with the known methods and collators in which there is a change in direction of feeding at right angles and where a second change at right angles would be necessary to obtain a return to the original general direction of feeding but spaced laterally therefrom.

What is claimed is:

1. A collator comprising a conveyor defining an essentially straight movement path along which plural sheets of material are adapted to be collated in superposed relation to each other, separate supplies of sheet material operatively arranged in side-by-side relation to each other and in lateral offset relation to said conveyor movement path, said conveyor and said supplies of material cooperating to bound in the angle subtended therebetween a triangular-shaped work station for performing said collation of said sheet material, and sheet-conveying means disposed at said work station operatively effective to move individual sheets fed thereon from said supplies thereof along plural angled paths intercepting said conveyor at selected locations in successively spaced relation therealong, whereby at each said intersecting location a different one of said individual sheets is deposited on said conveyor to thereby contribute to the build-up thereon of an assemblage of said sheets in a superposed collated condition.

2. A collator as defined in claim 1 wherein said conveyor is an endless pulley belt entrained at spaced apart locations about pulleys so as to define between said pulleys said straight movement path.

3. A collator as defined in claim 2 including an additional conveyor operatively disposed below the level of the discharge end of said pulley belt, to thereby facilitate the exiting removal of said collated material from said conveyor for further processing.

4. A collator as defined in claim 3 wherein said sheet-conveying means are spaced apart rollers cooperating to define plural angularly oriented material-conveying paths terminating in said intersecting relation with said conveyor, said rollers being effective to move the sheets simultaneously forwardly and progressively laterally onto said conveyor along said angled paths with optimum minimum difficulty in providing these two directions of movement because of the corresponding minimum surface contact established between the rollers and said sheets of material.

5. A collator as defined in claim 4 wherein said rollers are operatively arranged as cooperating pairs bounding said angled paths therebetween, whereby said rollers are adapted to exercise effective control over the movement of sheets of material interposed therebetween being urged in movement along said angled paths.

6. A collator as defined in claim 5 including a guide rail operatively arranged in parallel relation along the remote side of the conveyor movement path effective to limit the progressively lateral movement of the sheet material to thereby cause the deposit of said sheet material onto said conveyor.

* * * * *